US009865377B2

(12) United States Patent
Nakamura et al.

(10) Patent No.: US 9,865,377 B2
(45) Date of Patent: Jan. 9, 2018

(54) WIRE BUNDLE AND COMMUNICATION CABLE

(71) Applicant: YAZAKI ENERGY SYSTEM CORPORATION, Tokyo (JP)

(72) Inventors: Kouji Nakamura, Shizuoka (JP); Takahiro Suzuki, Shizuoka (JP)

(73) Assignee: YAZAKI ENERGY SYSTEM CORPORATION, Tokyo (JP)

( * ) Notice: Subject to any disclaimer, the term of this patent is extended or adjusted under 35 U.S.C. 154(b) by 0 days.

(21) Appl. No.: 15/265,535

(22) Filed: Sep. 14, 2016

(65) Prior Publication Data

US 2017/0076840 A1 Mar. 16, 2017

(30) Foreign Application Priority Data

Sep. 15, 2015 (JP) ..... 2015-182069

(51) Int. Cl.

| | |
|---|---|
| ***H01B 7/00*** | (2006.01) |
| ***H01B 11/00*** | (2006.01) |
| ***H01B 11/02*** | (2006.01) |
| ***H01P 3/04*** | (2006.01) |
| ***H01B 7/08*** | (2006.01) |

(Continued)

(52) U.S. Cl.

CPC ..... *H01B 11/04* (2013.01); *H01B 11/005* (2013.01); *H01B 7/02* (2013.01)

(58) Field of Classification Search

CPC ..... H01B 7/009; H01B 7/18; H01B 7/363; H01B 11/00; H01B 11/02; H01B 11/04; H01B 11/1839; H01B 11/203

USPC ..... 174/113 AS, 115, 117 AS, 117 R, 119 R, 174/129 R, 133 R

See application file for complete search history.

(56) References Cited

U.S. PATENT DOCUMENTS 4,230,898 A * 10/1980 Emmel ..... H01B 7/0838 174/117 F
4,572,926 A * 2/1986 Ganssle ..... H01B 7/046 174/102 SP (Continued)

FOREIGN PATENT DOCUMENTS

JP 2012079436 A * 4/2012
JP 2014-7018 A 1/2014

OTHER PUBLICATIONS

Nakamura (JP2012079436) Original Published Patent provided with Office Action.*

(Continued)

*Primary Examiner* — Chau N Nguyen
*Assistant Examiner* — Roshn Varghese
(74) *Attorney, Agent, or Firm* — Kenealy Vaidya LLP

(57) ABSTRACT

A wire bundle includes insulated wires. The insulated wires each includes a conductor core covered with an insulator and is quad-twisted to form the wire bundle. The wire bundle has an annular shape including an inner perimeter and an outer perimeter in a cross section perpendicular to an axis line of the wire bundle. A shape of the outer perimeter is a square or a quasi-square. The quasi-square is a shape formed by curving at least one side of a square to a radial inside direction of the annular shape in the cross section. The insulated wires each has, in the cross section, a shape connecting a plurality of vertexes including two adjacent vertexes of the square or the quasi-square and two vertexes present on the inner perimeter.

3 Claims, 8 Drawing Sheets

(51) Int. Cl.
*H01B 11/04* (2006.01)
*H01B 7/02* (2006.01)

(56) References Cited

U.S. PATENT DOCUMENTS

| | | | | |
|---|---|---|---|---|
| 4,912,446 | A * | 3/1990 | Singh | H01F 6/06 174/129 R |
| 6,751,382 | B2 * | 6/2004 | McGarvey | F16L 3/222 174/168 |
| 2008/0173465 | A1 * | 7/2008 | Nair | H01B 7/0876 174/117 FF |
| 2011/0220388 | A1 * | 9/2011 | Sabaris | H01B 7/184 174/113 R |

OTHER PUBLICATIONS

Nakamura (JP2012079436) Machine Translation of Description of Published Patent provided with Office Action.*

* cited by examiner

WIRE BUNDLE AND COMMUNICATION CABLE

CROSS-REFERENCES TO RELATED APPLICATION(S)

This application is based on and claims priority from Japanese Patent Application No. 2015-182069 filed on Sep. 15, 2015, and the entire contents of which are incorporated herein by reference.

BACKGROUND

Field of the Invention

This invention relates to a wire bundle and a communication cable having one or more wire bundles.

Description of Related Art

Communication cables are conventionally used in various networks (e.g., a telephone line, a railway signal protection device, a local area network (LAN), and a vehicle-mounted network (CAN)). Such a communication cable has a wire bundle(s) (a stranded wire(s)) formed by twisting insulated wires, which each include a conductor core covered with an insulator.

For example, one of conventional communication cables (hereinafter referred to as a "conventional cable") is formed by twisting a plurality of wire bundles (in particular, quad-stranded wires, which each is formed by twisting four insulated wires). Each of the wire bundles (quad-stranded wires) of this conventional cable has an annular shape (doughnut shape), which has a circular outer perimeter and a circular inner perimeter in a cross section perpendicular to an axis line of the wire bundle. Furthermore, each of the insulated wires of this wire bundle has a wedge-shaped protrusion and a recess corresponding to its protrusion, and is configured to mutually bond the adjacent insulated wires by engagement between the protrusion and the recess. The conventional cable is designed to eliminate a deformation of the quad shape (i.e., a relative displacement of the conductor cores) by this engagement to enhance the crosstalk attenuation characteristics, and is also designed to use an air layer of a region (hollow portion of the doughnut shape) surrounded by the inner perimeter of the wire bundle to reduce the electrostatic capacitance between the conductor cores to enhance the attenuation characteristics of a transmission signal.

As for details of the conventional example, refer to JP 2014-7018 A.

SUMMARY

The wire bundles (the quad-stranded wires) of the conventional cable are designed to eliminate the deformation of the quad shape by the mutual engagement between the protrusion and the recess formed on each of the insulated wires. However, a manufacturing process of such insulated wire, which has the protrusion and the recess, needs more complicated steps than a manufacturing process of a normal insulated wire (without the protrusion and the recess) due to a requirement to form the protrusion and the recess with high accuracy. Furthermore, in addition to the complicated manufacturing process of each of the insulated wires, a twisting process of the insulated wires needs more complicated steps than a twisting process of a normal insulated wire due to a requirement to accurately align the protrusions with the recesses and engage the protrusions to the recesses. Such complicated processes may cause an increase in a manufacturing cost of the wire bundles (and consequently a manufacturing cost of the communication cable).

On the other hand, eliminating the region (hollow portion) surrounded by the inner perimeter of the wire bundle of the conventional cable could eliminate the need for the protrusions and the recesses described above, since the area of contact between the insulated wires would increase to reduce the chance of losing the quad shape. However, eliminating the region (hollow portion) reduce the attenuation characteristics of a transmission signal, and thus is not preferable solution. As described above, the wire bundles (quad-stranded wires) of the conventional cable have an antinomy relation between an improvement in the attenuation characteristics of the transmission signal and ease of prevention of the loss of the quad shape (i.e. an improvement in the crosstalk attenuation characteristics).

It is an object of the present invention, in view of the above problems, to provide a wire bundle formed by quad-twisting insulated wires and capable of reducing the chance of losing its quad shape while keeping its structure as simple as possible and is excellent in the attenuation characteristics of a transmission signal, and a communication cable using the wire bundle.

Wire bundles according to the invention include the following (1) and (2), and a communication cable according to the invention includes the following (3).

(1)

A wire bundle comprising insulated wires, the insulated wires each including a conductor core covered with an insulator, the insulated wires being quad-twisted to form the wire bundle, the wire bundle having an annular shape including an inner perimeter and an outer perimeter in a cross section perpendicular to an axis line of the wire bundle, a shape of the outer perimeter being a square or a quasi-square, the quasi-square being a shape formed by curving at least one side of a square to a radial inside direction of the annular shape in the cross section, the insulated wires each having, in the cross section, a shape connecting a plurality of vertexes including two adjacent vertexes of the square or the quasi-square and two vertexes present on the inner perimeter.

(2)

The wire bundle according to item (1), wherein air is present inside of a region surrounded by the inner perimeter.

(3)

A communication cable comprising a wire bundle according to item (1).

According to the configuration of the above item (1), in the case of subjecting the wire bundle to an external force (for example, an external force of a direction, in which the wire bundle is crushed radially produced at the time of manufacturing and using the wire bundle), the outer perimeter of the cross-sectional shape of the wire bundle has the square etc. and the vertex of the cross-sectional shape of the insulated wire is positioned in the vertex of its square etc., and thus the external force can be received by an outer peripheral surface as well as a surface of contact between the insulated wires (for example, see FIGS. 4A to 4F). Hence, the loss of a quad shape of the wire bundle can be prevented without requiring a protrusion and a recess as shown in a wire bundle of a conventional cable. Furthermore, since the wire bundle has the annular shape, when a material (for example, air and foamed polyethylene) with a dielectric constant lower than that of the insulator is present in a hollow portion surrounded by the inner perimeter and thereby, electrostatic capacitance between the conductor cores is reduced to improve attenuation characteristics of a transmission signal as compared with the case of having no hollow portion. Consequently, the wire bundle of the invention can prevent the loss of the quad shape of the wire bundle by a structure simpler than that of the wire bundle (structure of engagement between the protrusion and the recess) of the conventional cable (in other words, the wire bundle of the invention can improve crosstalk attenuation characteristics), and is excellent in the attenuation characteristics of the transmission signal.

According to the configuration of the above item (2), the air available at low cost is present in the region (hollow portion) surrounded by the inner perimeter of the wire bundle, and thus a manufacturing cost of the wire bundle (and therefore a manufacturing cost of the communication cable) can be reduced compared with the case where another material (for example, foamed polyethylene) is present in the same region.

According to the configuration of the above (3), like the above (1), the communication cable with the present configuration can prevent the loss of the quad shape of the wire bundle by a structure simpler than that of the wire bundle (structure of engagement between the protrusion and the recess) of the conventional cable, and is excellent in the attenuation characteristics of the transmission signal. Furthermore, when air is present inside a region surrounded by the inner perimeter of the wire bundle of the communication cable, like the above (2), the communication cable with the present configuration CaO reduce the manufacturing cost of the communication cable.

According to the invention, the wire bundle is capable of reducing the chance of losing its quad shape while keeping its structure as simple as possible (in other words, is capable of improving the crosstalk attenuation characteristics) and can also improve the attenuation characteristics of the transmission signal by constructing each of the insulated wires so that the wire bundle has the annular shape and also the shape of the outer perimeter of the wire bundle is the square or the quasi-square.

The invention is briefly described above. Furthermore, some embodiments of the invention will be described below with some drawings to give clear details of the invention.

BRIEF DESCRIPTION OF THE DRAWINGS

FIG. 2A is a cross-sectional view of the wire bundle, and FIG. 2B is a perspective view illustrating a state in which one insulated wire is separated from the wire bundle, and FIG. 2C is a cross-sectional view of the one insulated wire.

FIG. 3A is a diagram illustrating a situation in which a plurality of insulated wires are twisted, and FIG. 3B is a front view of a wire dividing plate.

DETAILED DESCRIPTION

<Configuration of Wire Bundle and Communication Cable>

Configurations of a communication cable 10 and a wire bundle 20 according to one embodiment of the invention will hereinafter be described with reference to FIGS. 1 2A-2C, 3A and 3B.

Figure 1:
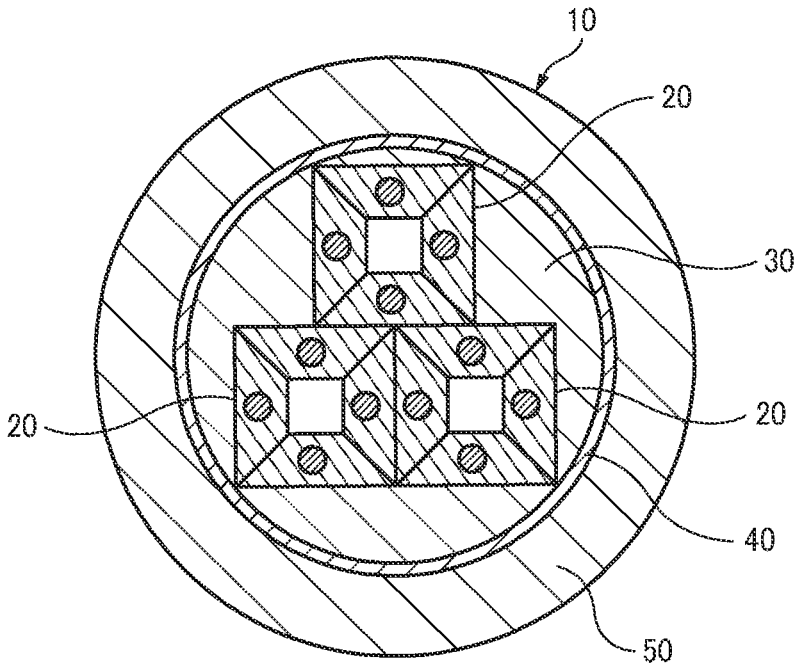
FIG. 1 is a cross-sectional view illustrating an embodiment of a communication cable according to the invention.

As shown in FIG. 1, the communication cable 10 includes a plurality of wire bundles (quad-stranded wires) 20, an interposed member 30, a press winding tape 40, and a sheath 50. The communication cable 10 is used as, for example, a wiring material of a vehicle-mounted network (CAN) of a vehicle. In the present embodiment, the communication cable 10 includes the three wire bundles 20. In addition, the number of wire bundles 20 included by the communication cable 10 is not necessarily limited to three, and the communication cable 10 can include any number of wire bundles 20 determined according to use etc. of the communication cable.

Figure 2A:
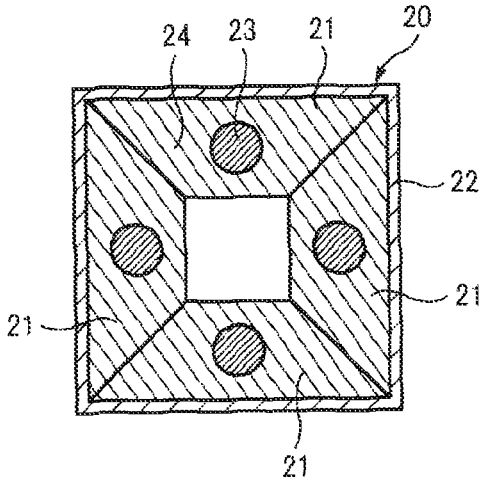
FIGS. 2A to 2C are views illustrating a wire bundle included by the communication cable of FIG. 1.

As shown in FIG. 2A, the wire bundle 20 includes four insulated wires 21 with the same shape, and a press winding tape 22. The wire bundle 20 has an annular shape having an inner perimeter and an outer perimeter in a cross section (cross section shown in FIG. 2A) perpendicular to an axis line of the wire bundle 20. More concretely, the wire bundle 20 has the annular shape (that is, a quadrangular tubular shape) in which shapes of the inner perimeter and the outer perimeter are squares in this cross section.

The insulated wire 21 includes a conductor core 23 formed by decreasing a diameter of a conductive metal such as copper, copper alloy and aluminum alloy, and an insulator 24 with which the conductor core 23 is covered. The insulator 24 is a thermoplastic resin such as polyvinyl chloride or polyethylene, and is formed so as to cover the periphery over the whole length of the conductor core 23 by extrusion molding etc. The insulated wire 21 has a shape (trapezoidal shape in the present example) connecting four vertexes including two adjacent vertexes of the square described above and two vertexes present on the inner perimeter in the cross section (cross section shown in FIG. 2A) perpendicular to the axis line of the wire bundle 20.

Figure 2B:
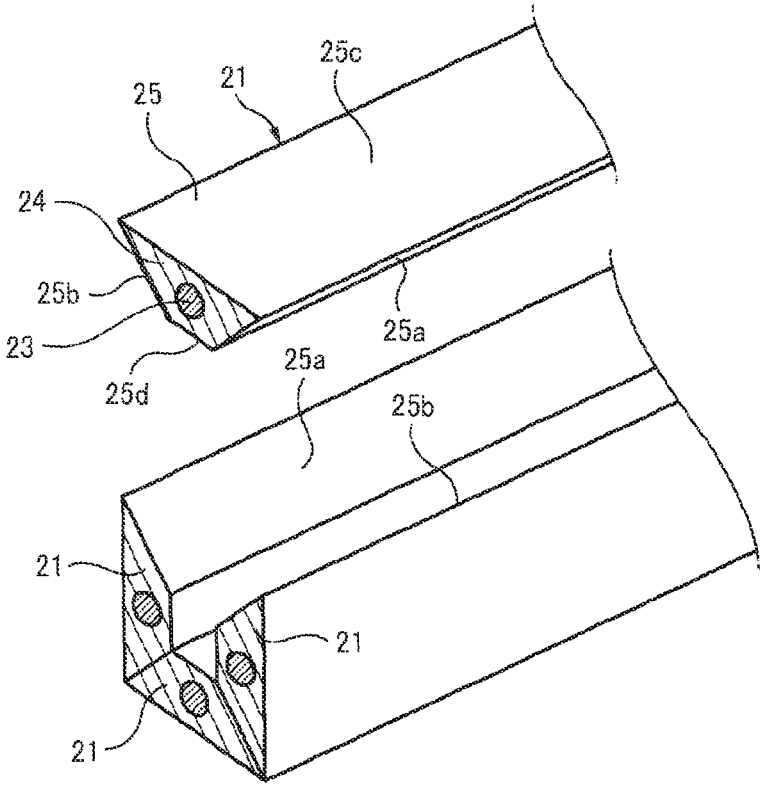

In particular, as shown in FIG. 2B, an outer peripheral surface 25 of the insulator 24 (hereinafter also referred to as the "outer peripheral surface 25 of the insulated wire 21") has a first plane part 25*a*, a second plane part 25*b*, a third plane part 25*c* and a fourth plane part 25*d*. The first plane part 25*a* is formed in parallel with the conductor core 23 in a length direction of the conductor core 23 over the whole length of the outer peripheral surface 25 of the insulator 24. The second plane part 25*b* has the same width as that of the first plane part 25*a*, and is formed in parallel with the conductor core 23 in the length direction of the conductor core 23 over the whole length of the outer peripheral surface 25 of the insulator 24.

The third plane part 25*c* is formed so as to join one end (point A in FIG. 2C) of the first plane part 25*a* in a width direction to one end (point B) of the second plane part 25*b* in the width direction. On the other hand, the fourth plane part 25*d* is formed so as to join the other end (point C) of the first plane part 25*a* in the width direction to the other end (point D) of the second plane part 25*b* in the width direction. In other words, as shown in FIG. 2C, in the cross section described above, a line segment 25*c* (third plane part 25*c*) which is a part of the outer perimeter of the wire bundle 20 corresponds to a straight line connecting two vertexes A, B of the square.

Figure 2C:
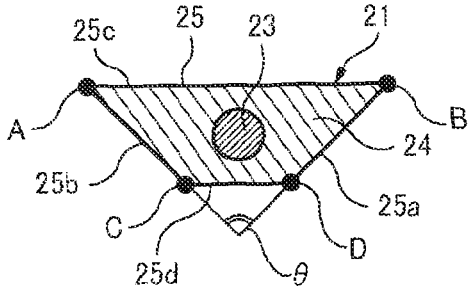

The insulator 24 is formed so that a cross-sectional shape of the insulator 24 is an isosceles trapezoid as shown in FIG. 2C. More concretely, the first plane part 25*a* and the second plane part 25*b* correspond to feet of the trapezoid, and the third plane part 25*c* corresponds to a lower base of the trapezoid, and the fourth plane part 25*d* corresponds to an upper base of the trapezoid. An angle θ between the first plane part 25*a* and the second plane part 25*b* is 90°. The third plane part 25*c* is mutually parallel to the fourth plane part 25*d*.

In other words, a shape of the outer peripheral surfaces 25 of the insulators 24 is designed to form one quadrangular tubular shape (shape in which cross-sectional inner perimeter and outer perimeter are squares) in the case of bundling (quad-twisted) the four insulated wires 21 into one. More concretely, the insulated wire 21 is designed so that a cross-sectional shape of the insulated wire 21 is a trapezoidal shape obtained by dividing the quadrangular tubular shape described above into four pieces. Accordingly, in the case of bundling the insulated wires 21, the first plane part 25*a* and the second plane part 25*b* of the insulated wire 21 make close contact with the first plane part 25*a* or the second plane part 25*b* of the other adjacent insulated wires 21 and also, the third plane parts 25*c* of the insulated wires 21 form an outer peripheral surface with the square in the cross section, and the fourth plane parts 25*d* of the insulated wires 21 form an inner peripheral surface with the square in the cross section.

Furthermore, air is present in a region (hollow portion of the quadrangular tubular shape) surrounded by the fourth plane parts 25*d*. In other words, an air layer is present between the conductor cores 23.

The press winding tape 22 is, for example, a non-woven tape made of polyester etc. The press winding tape 22 is spirally wound on the outer peripheral surface of the four insulated wires 21 bundled in the quadrangular tubular shape, and fixes these insulated wires 21 in a bundled state.

Again referring to FIG. 1, the interposed member 30 is, for example, a fibrillated paper made of polypropylene (PP) etc. As the interposed member 30, it is preferable to use a material having flexibility (flexibility) so that the communication cable 10 can be bent freely, for example, at the time of cabling the communication cable 10. The interposed member 30 is formed over the whole length of the communication cable 10 so as to fill a gap between the wire bundles 20.

The press winding tape 40 is, for example, a non-woven tape formed of polyester etc. similar to the press winding tape 22 described above. The press winding tape 40 is spirally wound on the communication cable 10 over the whole length of the communication cable 10 so as to form a transverse cross-sectional shape in a circular shape without a gap on the periphery of the interposed member 30.

The sheath 50 is, for example, an insulating flexible tube formed of synthetic resin such as polyethylene. The sheath 50 has the same length as that of wire bundle 20, and receives the wire bundles 20, the interposed member 30 and press winding tape 40 inside the sheath 50. Further, the sheath 50 is arranged so that an inner peripheral surface of the sheath 50 makes close contact with the press winding tape 40.

<Method for Manufacturing Wire Bundle and Communication Cable>

A method for manufacturing the communication cable 10 and the wire bundle 20 will hereinafter be described with reference to FIGS. 3A and 3B.

First, the wire bundle 20 used in the communication cable 10 is manufactured. The insulated wire 21 used in the wire bundle 20 is manufactured by drawing the preheated conductor core 23 using, for example, an extrusion molding machine including an extrusion die (a cross-head die etc.) and also stacking a melted extrusion molding on the periphery and forming the insulator 24. At this time, a shape of the die is preset so as to form a cross-sectional shape of the insulator 24 (that is, the insulated wire 21) in the trapezoidal shape described above.

Figure 3A:
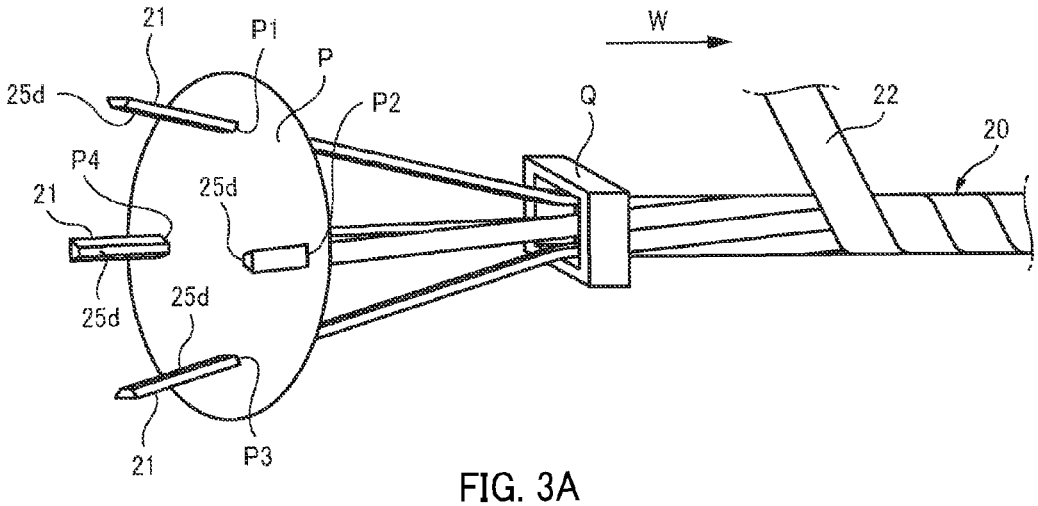
FIGS. 3A and 3B are diagrams describing a method for manufacturing the communication cable.
Figure 3B:
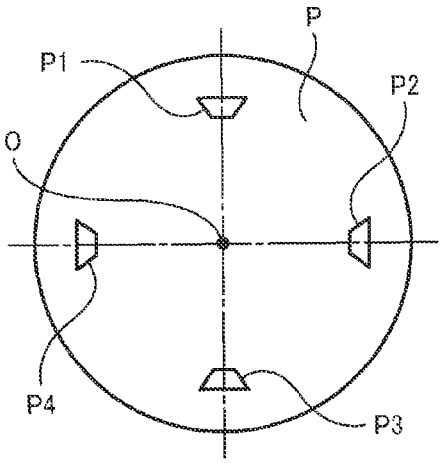

Next, after the insulated wires 21 manufactured as described above are made to extend through four trapezoidal holes P1 to P4 bored in a wire dividing plate P, the insulated wires 21 are made to extend through an annular member Q as shown in FIG. 3A. The wire dividing plate P is formed in a circular plate shape, and the four trapezoidal holes P1 to P4 are formed symmetrically with respect to the center O of the wire dividing plate P as shown in FIG. 3B. Each of the four trapezoidal holes P1 to P4 is formed in the trapezoidal shape according to the cross-sectional shape of the insulated wire 21, and is arranged so that each of the upper bases (see 25*d* of FIG. 2C) faces to the center O of the wire dividing plate P. Accordingly, when the insulated wires 21 extend through the member Q, the fourth plane parts 25*d* of the insulated wires 21 are arranged so as to face mutually.

After that, while the insulated wires 21 extending through the member Q are pulled in a direction W away from the member Q, the first plane part 25*a* and the second plane part 25*b* of each of the insulated wires 21 make close contact with the first plane part 25*a* or the second plane part 25*b* of the other adjacent insulated wires 21 and also, the insulated wires 21 are mutually bundled and stranded so that the third plane part 25*c* and the fourth plane part 25*d* in each of the insulated wires 21 abut mutually respectively. That is, the four insulated wires 21 are quad-twisted. The insulated wires 21 stranded in this manner has the quadrangular tubular shape by mutually connecting the third plane parts 25*c* and mutually connecting the fourth plane parts 25*d*. Thereafter, the press winding tape 22 is spirally wound on the outer peripheral surface of the stranded insulated wires 21.

The wire bundle 20 is manufactured through the above steps.

Then, the press winding tape 40 is wound to fix the wire bundles 20 so as to form the wire bundles 20 in a cross-sectional circular shape while the three wire bundles 20 are bundled and also a gap between the wire bundles 20 is filled with the interposed member 30. Thereafter, the sheath 50 is formed on the periphery of the press winding tape 40 by extrusion molding etc.

The communication cable 10 is manufactured through the above steps.

<Resistance of Wire Bundle to External Force>

Resistance of the wire bundle 20 manufactured as described above to an external force will hereinafter be described with reference to FIGS. 4A to 4F and FIG. 5.

The wire bundle 20 is subjected to an external force under various circumstances. For example, when the wire bundles 20 are bundled in order to form the communication cable 10 in the manufacturing step described above, the wire bundles 20 are generally delivered to a processing device through a roller. At this time, the wire bundles 20 are subjected to an external force pressed on a surface of the roller in, for example, the case of a change in a direction of delivery of the wire bundles 20 along an outer peripheral surface of the roller. Also, even after the communication cable 10 is formed, the wire bundles 20 of the inside of the communication cable 10 are subjected to the external force when the communication cable 10 is pressed on a peripheral member in the case of cabling the communication cable 10 in a vehicle etc.

Figure 4A:
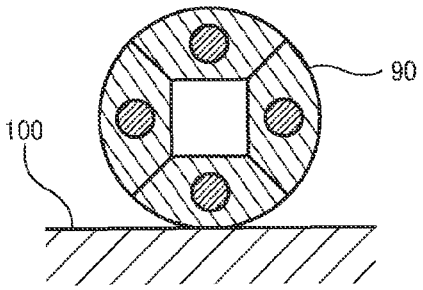
FIGS. 4A to 4C are cross-sectional views illustrating shapes of wire bundles in the case of subjecting a conventional wire bundle to an external force.
Figure 4D:
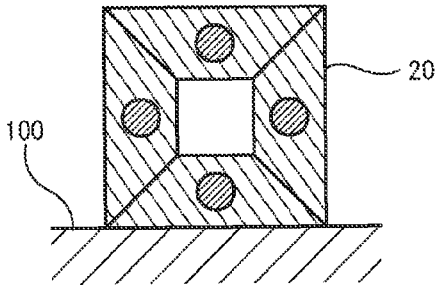
FIGS. 4D to 4F are cross-sectional views illustrating shapes of the wire bundles in the case of subjecting the wire bundle of the present embodiment to an external force.
Figure 4B:
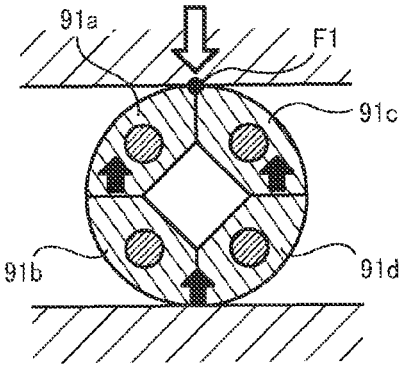
Figure 4E:
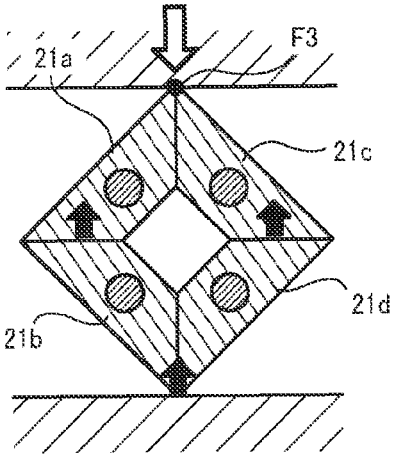
Figure 4C:
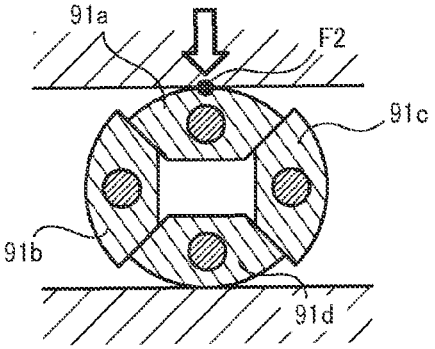
Figure 4F:
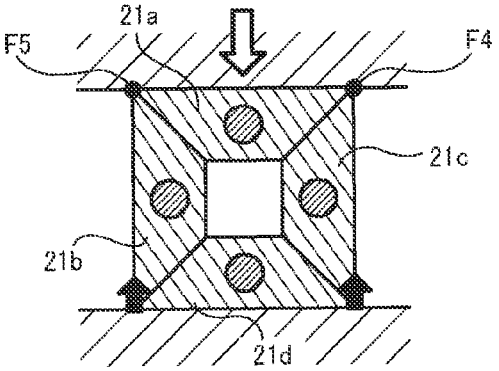

FIGS. 4A to 4F are schematic diagrams illustrating a cross-sectional shape of the wire bundle 20 in the case of subjecting the wire bundle 20 to an external force by which the wire bundle 20 is crushed from a direction perpendicular to a flat plate 100 with respect to the wire bundle 20 placed on the flat plate 100 in order to describe resistance of the wire bundle 20 to such an external force. FIGS. 4A to 4C represent resistance of a conventional wire bundle 90 (an outer peripheral shape in a cross section is a circular shape) to an external force, and FIGS. 4D to 4F represent resistance of the wire bundle 20 of the present embodiment to an external force. In addition, for the sake of convenience, in FIG. 4, illustration of the press winding tape is omitted in both of the wire bundle 20 and the wire bundle 90. In FIGS. 4A to 4F, white arrows show the external forces and black arrows show reaction forces caused by the external forces.

First, in the case of subjecting a position F1 in the vicinity of a surface of contact between adjacent insulated wires to an external force (see the white arrow) as shown in FIG. 4B for the conventional wire bundle 90 shown in FIG. 4A, its external force is transmitted to the flat plate 100 through a surface of contact between an insulated wire 91*a* and an insulated wire 91*b*, and a surface of contact between an insulated wire 91*c* and an insulated wire 91*d*. As a result, a reaction force opposite to the external force (see the black arrows in FIG. 4B) is produced at a point of contact between the flat plate 100 and the wire bundle 90, and its reaction force is transmitted to the position F1 subjected to the external force through the surface of contact between the insulated wires 91*a*, 91*b* and the surface of contact between the insulated wires 91*c*, 91*d*. At this time, the external force is substantially balanced with the reaction force in each of the insulated wires 91*a* to 91*d*. As a result, in this case, positions of the insulated wires 91*a* to 91*d* are not substantially changed and a quad shape of the wire bundle 90 can be maintained.

On the other hand, when a force in a slide direction by an external force exceeds a static frictional force between the insulated wires in the case of subjecting a position F2 of the center periphery of the insulated wire to the external force as shown in FIG. 4C, a slip between the insulated wires is caused on the surface of contact between the insulated wires 91*a*, 91*b*, a surface of contact between the insulated wires 91*a*, 91*c*, a surface of contact between the insulated wires 91*b*, 91*d*, and the surface of contact between the insulated wires 91*c*, 91*d*. As a result, the quad shape is lost. In addition, at this time, the external force is not sufficiently transmitted to the flat plate 100, with the result that a sufficient reaction force is not produced. As a result, in the case of an example shown in FIG. 4C, the loss of the quad shape progresses until the insulated wires 91*b*, 91*c* make contact with the upper and lower flat plates 100.

Figure 5:
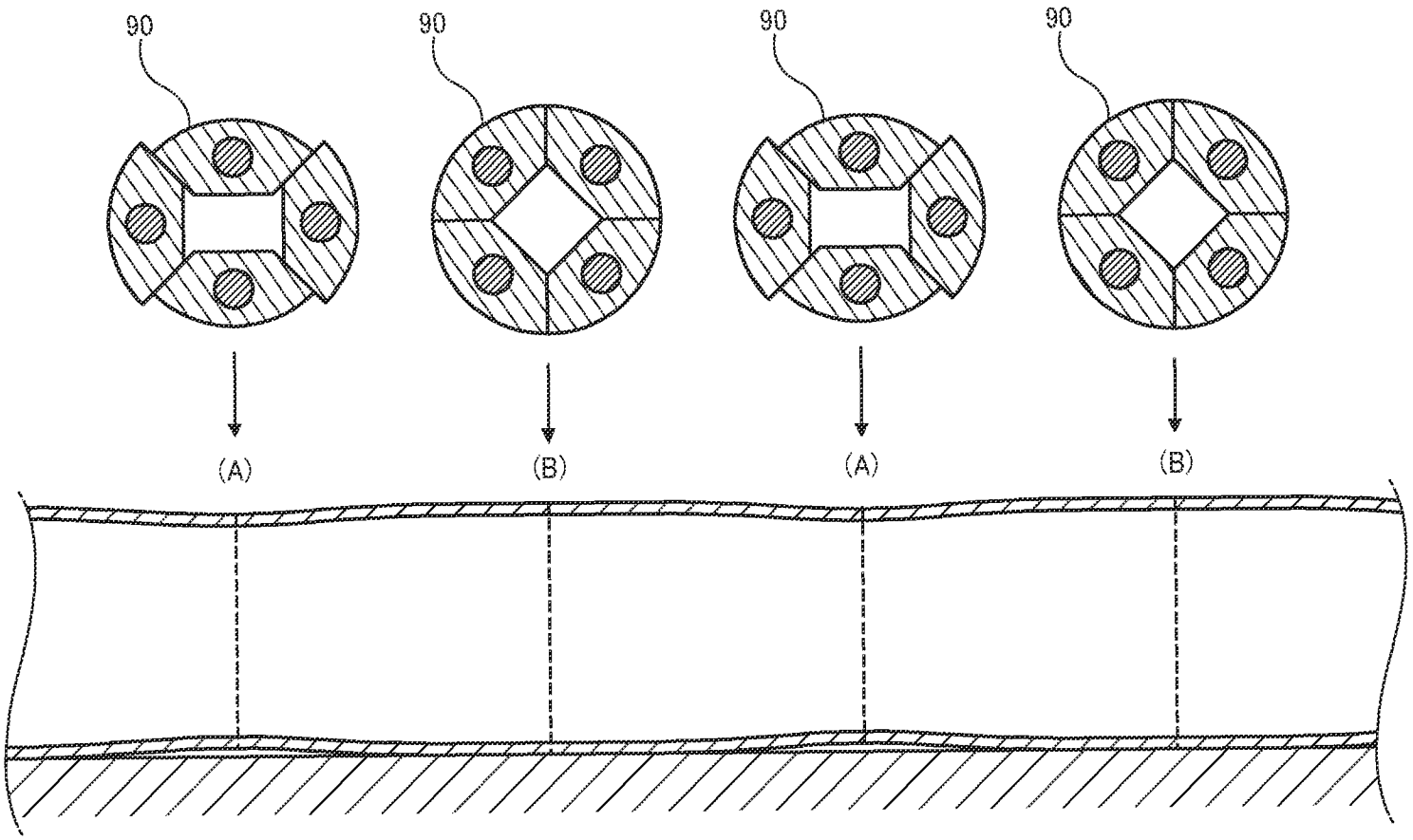
FIG. 5 is a side view illustrating the shapes of the wire bundles in the case of subjecting the conventional wire bundle to the external force.

As a result, in the case of viewing the conventional wire bundle 90 from a side surface as shown in FIG. 5, a portion (A) difficult to maintain the quad shape with respect to the external force and a portion (B) easy to maintain the quad shape with respect to the external force are alternately caused according to a twist of the wire bundle 90. From the standpoint of improving crosstalk attenuation characteristics of the wire bundle 90, it is not desirable to cause the portion (A) impossible to maintain the quad shape in this manner.

On the other hand, in the case of subjecting the vicinity F3 of a surface of contact between the adjacent insulated wires 21 to an external force as shown in FIG. 4E for the wire bundle 20 according to the present embodiment shown in FIG. 4D, its external force is transmitted to the flat plate 100 through a surface of contact between an insulated wire 21*a* and an insulated wire 21*b*, and a surface of contact between an insulated wire 21*c* and an insulated wire 21*d*. As a result, a reaction force opposite to the external force is produced at a point of contact between the flat plate 100 and the wire bundle 20, and its reaction force is transmitted to the position F3 subjected to the external force through the surface of contact between the insulated wires 21*a*, 21*b* and the surface of contact between the insulated wires 21*c*, 21*d*. At this time, the external force is substantially balanced with the reaction force in each of the insulated wires 21*a* to 21*d*. As a result, in this case, positions of the insulated wires 21*a* to 21*d* are not substantially changed and a quad shape of the wire bundle 20 can be maintained similarly to an example shown in FIG. 4B.

Further, in the case of subjecting the whole outer peripheral surface (for the sake of convenience, positions F4 and F5) of the insulated wire 21 to an external force as shown in FIG. 4F, its external force is directly transmitted to the flat plate 100 through outer peripheral surfaces of the insulated wires 21*b*, 21*c*. As a result, reaction forces opposite to the external force are produced at points of contact between the flat plate 100 and the insulated wires 21*b*, 21*c*, and the reaction forces are transmitted to the positions F4 and F5 through the outer peripheral surfaces of the insulated wires 21*b*, 21*c*. At this time, the external force is substantially balanced with the reaction forces in each of the insulated wires 21*a* to 21*d*. As a result, in this case, positions of the insulated wires 21*a* to 21*d* are not substantially changed and the quad shape of the wire bundle 20 can be maintained.

Figure 6:
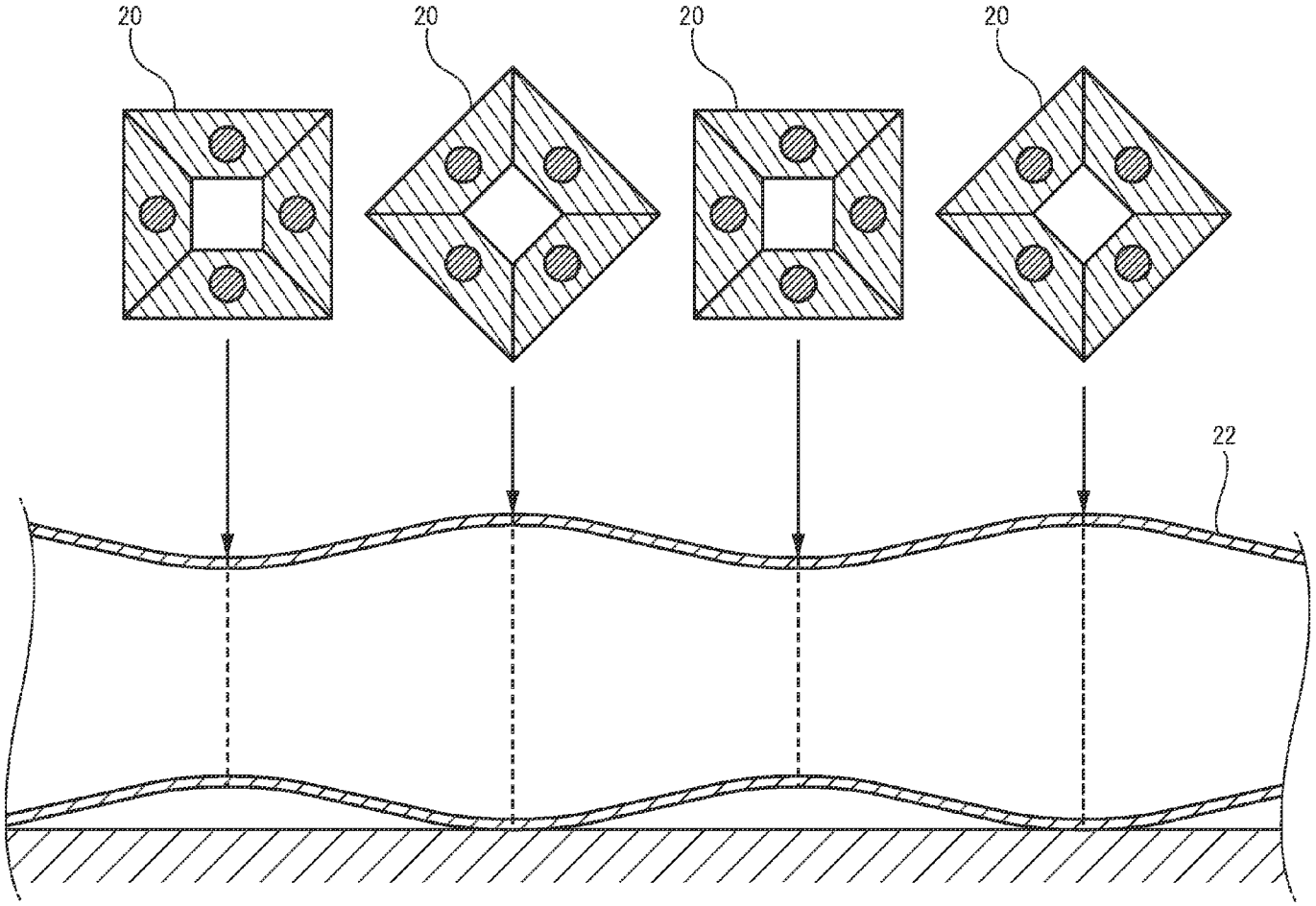
FIG. 6 is a side view illustrating the shapes of the wire bundles in the case of subjecting the wire bundle of the present embodiment to the external force.

As a result, in the case of viewing the wire bundle 20 from a side surface as shown in FIG. 6, a portion difficult to maintain the quad shape with respect to the external force becomes smaller than the conventional wire bundle 90 (FIG. 5). Hence, the wire bundle 20 has higher resistance to the external force (can maintain the quad shape) than the conventional wire bundle 90 (FIG. 5).

According to the present embodiment as described above, in the case of subjecting the wire bundle to the external force (for example, see FIG. 4), the outer perimeter of the cross-sectional shape of the wire bundle has the square and the vertex of the cross-sectional shape of the insulated wire is positioned in the vertex of its square, with the result that the external force can be received by the outer peripheral surface as well as the surface of contact between the insulated wires. Hence, the loss of the quad shape can be prevented, and crosstalk attenuation characteristics can be maintained. Further, in the wire bundle, air is present in the hollow portion surrounded by the inner perimeter and thereby, attenuation characteristics of a transmission signal are improved, <Other Embodiment>

The invention is not limited within the above specific embodiments, various modifications corrections may be made without departing from the scope of the invention.

Figure 7:
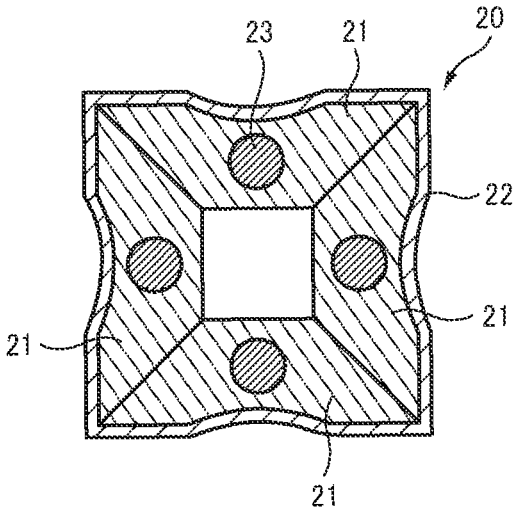
FIG. 7 is a cross-sectional view illustrating a wire bundle according to another embodiment of the invention.

For example, the wire bundle 20 of the embodiment described above has the quadrangular tubular shape in which the outer perimeter and the inner perimeter have the squares in the cross section perpendicular to the axis line of the wire bundle 20. However, the cross-sectional shape of the outer perimeter of the wire bundle of the invention is not necessarily limited to the square. For example, as shown in FIG. 7, the wire bundle 20 may have the annular shape having the inner perimeter and the outer perimeter in the cross section perpendicular to the axis line of the wire bundle 20, and may have the annular shape in which a shape of the outer perimeter is a shape (quasi-square) in which at least one side (all the sides in FIG. 7) of the square is curved to a radial inside of the annular shape in the cross section. Also, when the wire bundle 20 has such a cross-sectional shape, the quad shape can be maintained more surely than the conventional wire bundle 90 as can be seen from the above description.

Figure 8:
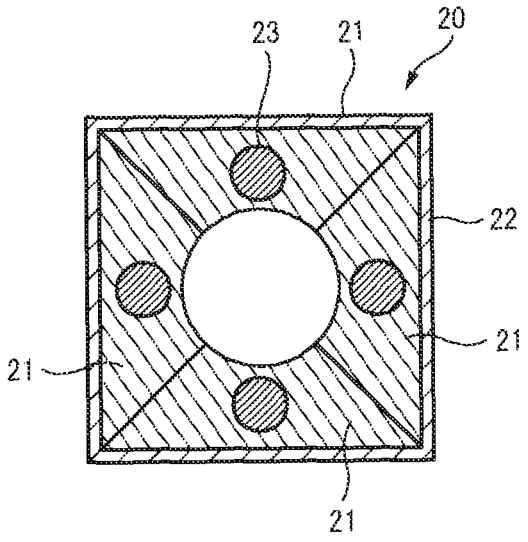
FIG. 8 is a cross-sectional view illustrating a wire bundle according to a further embodiment of the invention.

Further, for example, the cross-sectional shape of the inner perimeter of the wire bundle of the invention is not necessarily limited to the square. For example, as shown in FIG. 8, the wire bundle 20 may have the annular shape having the inner perimeter and the outer perimeter in the cross section perpendicular to the axis line of the wire bundle 20, and may have the annular shape in which a shape of the inner perimeter is a circle. From the standpoint of improving attenuation characteristics of a transmission signal of the wire bundle 20, it is preferable that a thickness of a layer (for example, an air layer) of a low-dielectric object present between the conductor cores should be thicker. Hence, for example, the cross-sectional shape of the inner perimeter is formed in the circle whose area is larger than that of the square shown in FIG. 2A and thereby, the attenuation characteristics of the transmission signal of the wire bundle 20 are improved more than the example shown in FIG. 2A. Further, as the same area is larger, the attenuation characteristics of the transmission signal are improved more. In addition, the circle is only one example, and the attenuation characteristics of the transmission signal are improved as long as the cross-sectional shape of the inner perimeter of the wire bundle 20 is a shape capable of thickening the layer of the low-dielectric object present between the conductor cores even when its cross-sectional shape is other shapes.

Here, the characteristics of the above embodiment of the wire bundle of the invention are described briefly as the following item (1) and (2), and the characteristic of the embodiment of the communication cable of the invention is described briefly as the following item (3).

(1)

A wire bundle (20) comprising insulated wires (21), the insulated wires each including a conductor core (23) covered with an insulator (24), the insulated wires being quad-twisted to form the wire bundle, the wire bundle (20) having an annular shape including an inner perimeter (25*d*) and an outer perimeter (25*c*) in a cross section perpendicular to an axis line of the wire bundle, a shape of the outer perimeter (25*c*) being a square or a quasi-square, the quasi-square being a shape formed by curving at least one side of a square to a radial inside direction of the annular shape in the cross section, the insulated wires (21) each having, in the cross section, a shape connecting a plurality of vertexes including two adjacent vertexes (A, B) of the square or the quasi-square and two vertexes (C, D) present on the inner perimeter.

(2)

The wire bundle according to item (1), wherein air is present inside of a region surrounded by the inner perimeter (25*d*).

(3)

A communication cable (10) comprising a wire bundle (20) according to item 1.

REFERENCE SIGNS LIST

10 Communication cable
20 Wire bundle
21 Insulated wire
23 Conductor core
24 Insulator
25 Outer peripheral surface of insulated wire

The invention claimed is:

1. A wire bundle comprising insulated wires, the insulated wires each including a conductor core covered with an insulator, the insulated wires being quad-twisted to form the wire bundle, the wire bundle having an annular shape including an inner perimeter and an outer perimeter in a cross section perpendicular to an axis line of the wire bundle, a shape of the outer perimeter being a square or a quasi-square defining four corners, the quasi-square including a concave portion on at least one side, the insulated wires each having, in the cross section, a shape connecting a plurality of vertexes including two corners of the square or the quasi-square that share a common side.

2. The wire bundle according to claim 1, wherein air is present inside of a region surrounded by the inner perimeter.

3. A communication cable comprising a wire bundle according to claim 1.

* * * * *